US005934467A

United States Patent [19]

Gilfert et al.

[11] Patent Number: 5,934,467

[45] Date of Patent: Aug. 10, 1999

[54] MOLDED ROLL SUPPORT AND SPACING STRUCTURE

[75] Inventors: James W. Gilfert, Eldreld, Pa.; Robert W. Crandall, Great Valley; Loren D. Ervay, Olean, both of N.Y.

[73] Assignee: Great Northern Corporation, Appleton, Wis.

[21] Appl. No.: 09/099,175

[22] Filed: Jun. 18, 1998

[51] Int. Cl.[6] ..... B65D 85/66

[52] U.S. Cl. ..... 206/391; 206/593

[58] Field of Search ..... 206/391, 393, 206/413, 419, 386, 593, 597, 443; D9/456

[56] References Cited

U.S. PATENT DOCUMENTS

| | | | |
|---|---|---|---|
| D. 381,180 | 7/1997 | Schueneman et al. | D34/38 |
| D. 385,080 | 10/1997 | Schueneman et al. | D34/38 |
| D. 403,961 | 1/1999 | Warren | D9/346 |
| 3,708,084 | 1/1973 | Bixler et al. | 206/443 |
| 4,195,732 | 4/1980 | Bell | 206/443 |
| 4,435,463 | 3/1984 | Roellchen | 206/391 |
| 4,832,196 | 5/1989 | Butler | 206/391 |
| 5,080,314 | 1/1992 | Moyer et al. | 206/391 |

*Primary Examiner*—David T. Fidei

*Attorney, Agent, or Firm*—Andrus, Sceales, Starke & Sawall

[57] ABSTRACT

An improved roll support and spacing structure for packaging and handling of multi-layer stacks of rolls of web material. The structure is preferably an elongated molded pulp member. Rolls of web material fit into generally semi-cylindrical indentations in the roll support structure. The generally semi-cylindrical roll cushioning indentations are smooth and free of recesses, and thus substantially eliminate marking, denting and/or scratching associated with such recesses. The smooth, generally semi-cylindrical roll cushioning indentations are crowned to improve strength and reduce sagging during fabrication. Raised lands are located between the roll cushioning indentations. The resulting roll support structure provides the proper combination of strength and flexibility to appropriately cushion the rolls. The formed roll support structure also includes chamfered portions between the smooth crowned roll cushioning indentations and adjacent sidewalls to substantially eliminate markings associated with sidewall rigidity. Preferably, the roll support structure includes two substantially similar elongated members disposed in parallel across a longitudinal hinge. The longitudinal hinge preferably includes elongated formed openings located exclusively between selected aligned lands to facilitate bending and/or tearing along the hinge line.

18 Claims, 6 Drawing Sheets

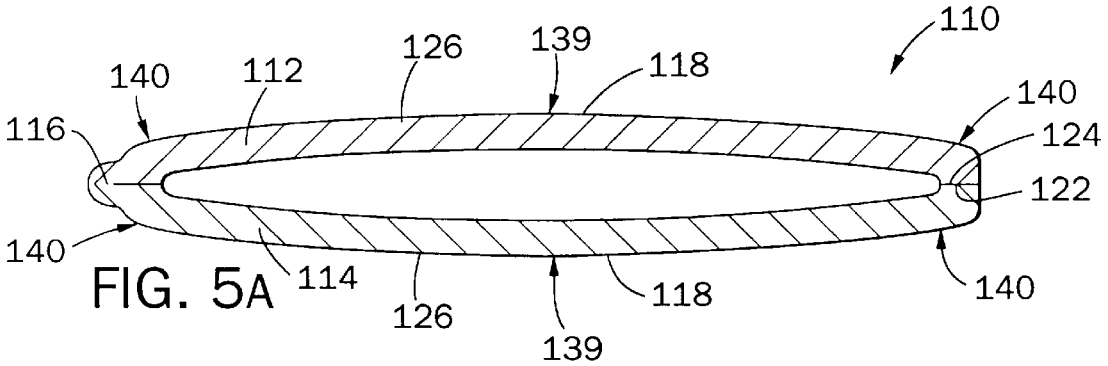
FIG. 5A
FIG. 5B
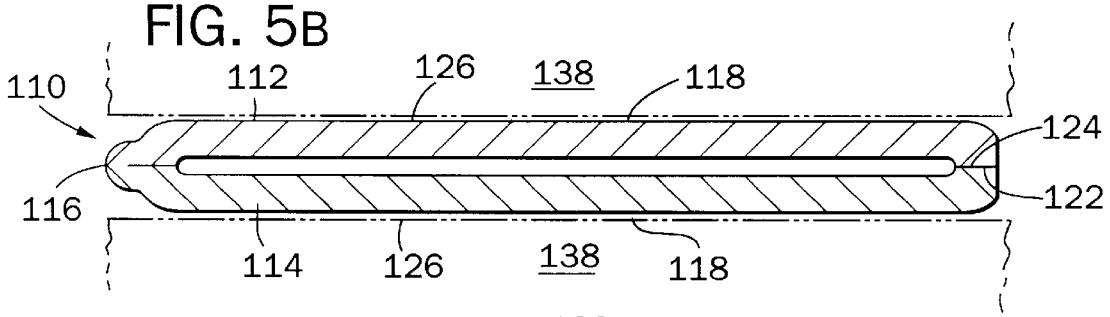
FIG. 6A
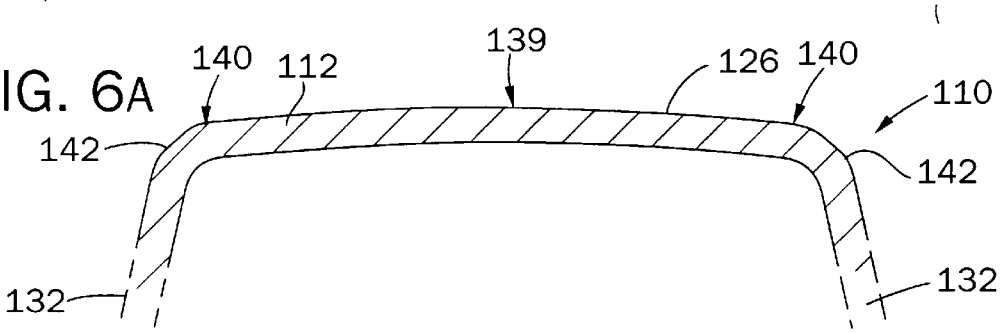
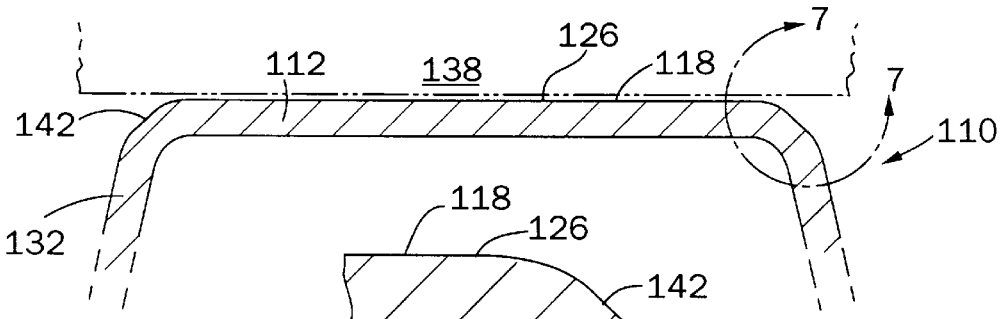
FIG. 6B
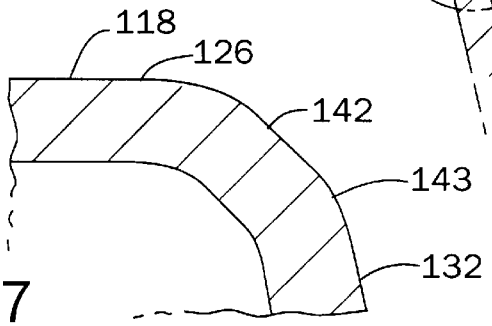
FIG. 7

MOLDED ROLL SUPPORT AND SPACING STRUCTURE

FIELD OF THE INVENTION

The invention relates to the packaging of rolls of web material for shipping and the like. In particular, the invention is an improved structure preferably made from molded pulp for protectively supporting and spacing rolls of web material in a multi-layer stack.

BACKGROUND OF THE INVENTION

U.S. Pat. No. 4,195,732 (Bell), which is assigned to the assignee of this application, discloses a highly successful roll support and spacing member. The structure disclosed in the Bell patent is formed from an elongated bar of expanded foam material such as polystyrene. The structure is used for palletizing rolls of web material, such as film or the like, and cushions the rolls to protect against damage in handling and shipment. The elongated bars include a plurality of spaced, semi-cylindrical roll indentations along at least one of their surfaces to receive the rolls of web material. In order to effectively protect the rolls of web material, the semi-cylindrical indentations provide a relatively snug fit against the respective roll. The relatively snug fit prevents severely uneven load distribution which can flatten rolls. In some circumstances, flattened rolls are unusable to the end user. In addition, relatively even load distribution over the indentation is important to eliminate denting or scratching of the roll. Scratches on rolls often cause zippering when the roll is run on a web machine, thus rendering the roll completely unusable. The elongated bars of expanded foam also include a plurality of recesses located within or adjacent the side portions of the semi-cylindrical roll indentations to provide flexural cushioning. The flexural cushioning recesses in the semi-cylindrical roll indentations provide for the requisite balance between strength and flexibility, and prevent the foam bars from cracking in use. In such construction, the bars are permitted to conform to different diameter rolls without causing breakage to the bars or load collapse. The bars of the Bell patent permit limited relative movement among the rolls of the stack while, at the same time, are of sufficient strength to prevent crushing and collapse of the stack.

In use, the elongated bars of the Bell patent may be placed between the bottom layer of rolls and the supporting pallet, between subsequent layers of rolls in the stack, and on top of the top layer of the stack. In one form of stacking arrangement, each layer contains a number of rolls of web material arranged in parallel and axial orientation. The supporting bars may be arranged parallel to one another and spaced apart with the end portions of each roll supported on a semi-cylindrical roll indentation provided on adjacent spaced bars. For example, a semi-cylindrical roll indentation provided by an interiorly located bar normally supports the end portions of two rolls of web material. Also, the Bell patent discloses one embodiment which provides an integral lip along one of the outside edges of the semi-cylindrical roll indentation to protect an otherwise exposed axial end of a roll from nicks or other damage.

Although the expanded foam roll support and spacing members as disclosed in the Bell patent have been highly successful, many companies (including the assignee of this application) have more recently also begun to manufacture somewhat similar roll support and spacing members made from molded pulp. It is important that such molded pulp roll support and spacing members have sufficient strength to prevent crushing and collapse of the stack, and also have sufficient flexibility to permit limited relative movement among the rolls of the stack. Heretofore, molded pulp roll support and spacing members have also normally included recesses in the semi-cylindrical roll indentations. The recesses are important to provide the molded pulp roll support and spacing members with the delicate balance between strength and flexibility necessary for adequate cushioning of the rolls.

Recesses in the semi-cylindrical roll indentations of molded pulp roll support and spacing members have been deemed critical for several reasons. First, the recesses strengthen the dried molded pulp member to prevent crushing of the member under heavy loads. If crushing occurs, stacks can loosen. Also, load distribution on the rolls of web material is compromised, and the rolls of web material can flatten. In addition, the presence of recesses in the semi-cylindrical indentations maintains the strength of the cushioning roll indentations for the rolls even when the diameter of the rolls is reasonably inconsistent (e.g. 1 to 2 inch variance in roll diameter among rolls). Secondly, the recesses help to maintain the shape and dimension of the semi-cylindrical roll indentations during the fabrication process. As mentioned, it is important for performance that the shape and dimensions of the semi-cylindrical roll indentations be maintained within suitable tolerances. The recesses help in this regard by supporting the wet molded pulp member during the drying process to prevent sagging or other similar distortions.

Recesses and/or ridges in the semi-cylindrical roll indentations, however, often mark, dent or scratch the roll (e.g. nicks, creases, etc.) especially under heavy loads.

SUMMARY OF THE INVENTION

The invention is a molded roll support member that has one or more generally semi-cylindrical roll cushioning indentations. The roll support member is preferably fabricated from dried molded pulp. In order to maintain sufficient strength and prevent sagging during fabrication, the generally semi-cylindrical roll indentation is crowned such that a transverse cross section of the indentation surface is convex. Preferably, the crown, while sufficient to provide strength in use and prevent undue sagging during fabrication, is sufficiently slight (e.g. ⅛ inch elevation at apex of crown) so that loads remain relatively evenly distributed over the surface of the roll cushioning indentation.

Removing the recesses in the generally semi-cylindrical roll cushioning indentation results in a generally smooth surface and reduces the possibility of creating marks on stacked rolls which are sometimes caused by the presence of such recesses. However, even with the recesses removed, marking, denting or scratching can occur because of the rigidity of sidewalls adjacent the roll cushioning indentation. In order to eliminate denting, marking or scratching associated with sidewall rigidity, a chamfered surface extends between the generally semi-cylindrical roll cushioning indentation and the respective sidewall surface. The chamfered surface may form approximately a 45° angle with the sidewall, and is located adjacent to the sidewalls that could possibly mark, dent or scratch rolls of web material.

The preferred structure includes two elongated members that are formed parallel to each other and connected by an integral molded pulp hinge therebetween. The structure includes a face side (e.g. a molded surface) and a back side (e.g. a felted surface). The back side surface has a peripheral engagement portion. The elongated members include raised lands which are positioned between a plurality of generally semi-cylindrical roll cushioning indentations. Sidewalls at least partially support the semi-cylindrical roll indentations and raised lands with respect to the peripheral engagement portion of the back side. When the structure is folded along the hinge, the peripheral engagement portion of the back side for the first elongated member aligns with the peripheral engagement portion of the back side for the second elongated member. As folded, the roll support structure is placed between respective layers of rolls of web material in the multi-layer stack. For the top and bottom layer, the roll support structure is broken or cut along the hinge. In accordance with another aspect of the invention, the hinge includes a plurality of elongated formed openings to facilitate bending and breaking along the hinge. The formed openings are preferably located on the hinge exclusively between selected aligned lands located between the generally semi-cylindrical roll cushioning indentations.

As should be apparent to those skilled in the art, the invention provides an improved roll support structure that has sufficient strength and flexibility to prevent crushing and collapse of the stack, yet provides generally semi-cylindrical roll cushioning indentations free of recesses or other excessively rigid areas. The invention therefore substantially eliminates creasing and marking problems that are sometimes prevalent when using molded pulp roll support and spacing members.

Other features and advantages may be apparent to those skilled in the art upon reviewing the following drawings and description thereof.

BRIEF DESCRIPTION OF THE DRAWINGS

Prior Art

Present Invention

Figure 2:
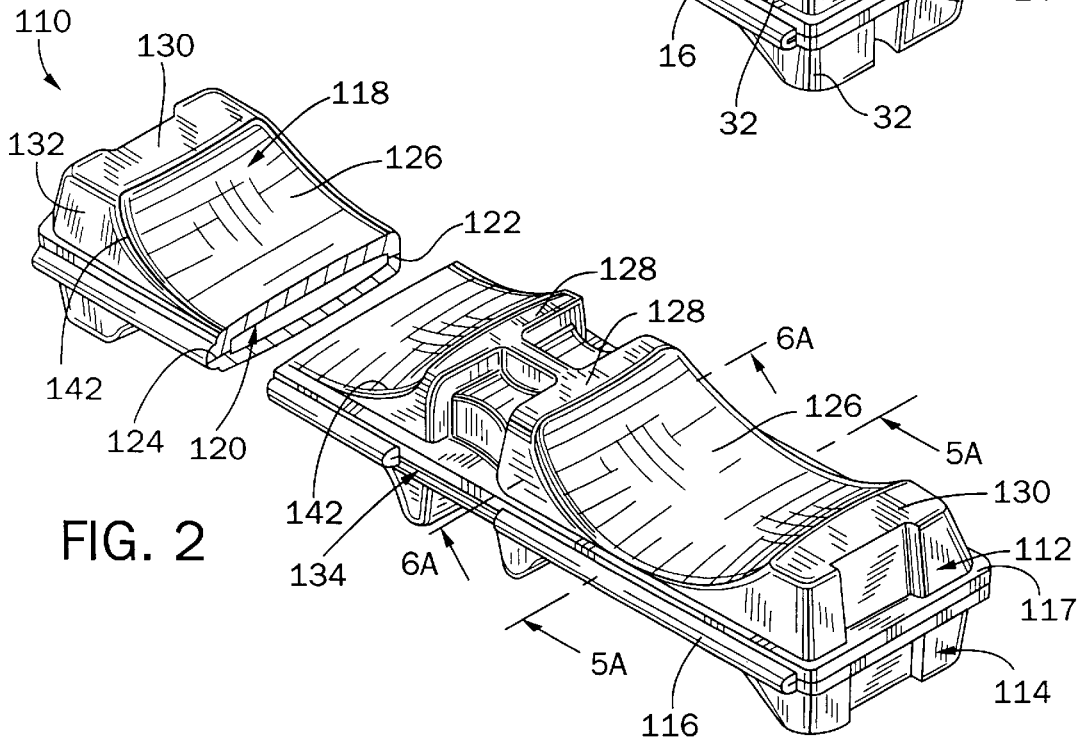

FIG. 2 is a molded pulp roll support and spacing structure having smooth and crowned, generally semi-cylindrical roll cushioning indentations as in accordance with the invention.

Figure 3:
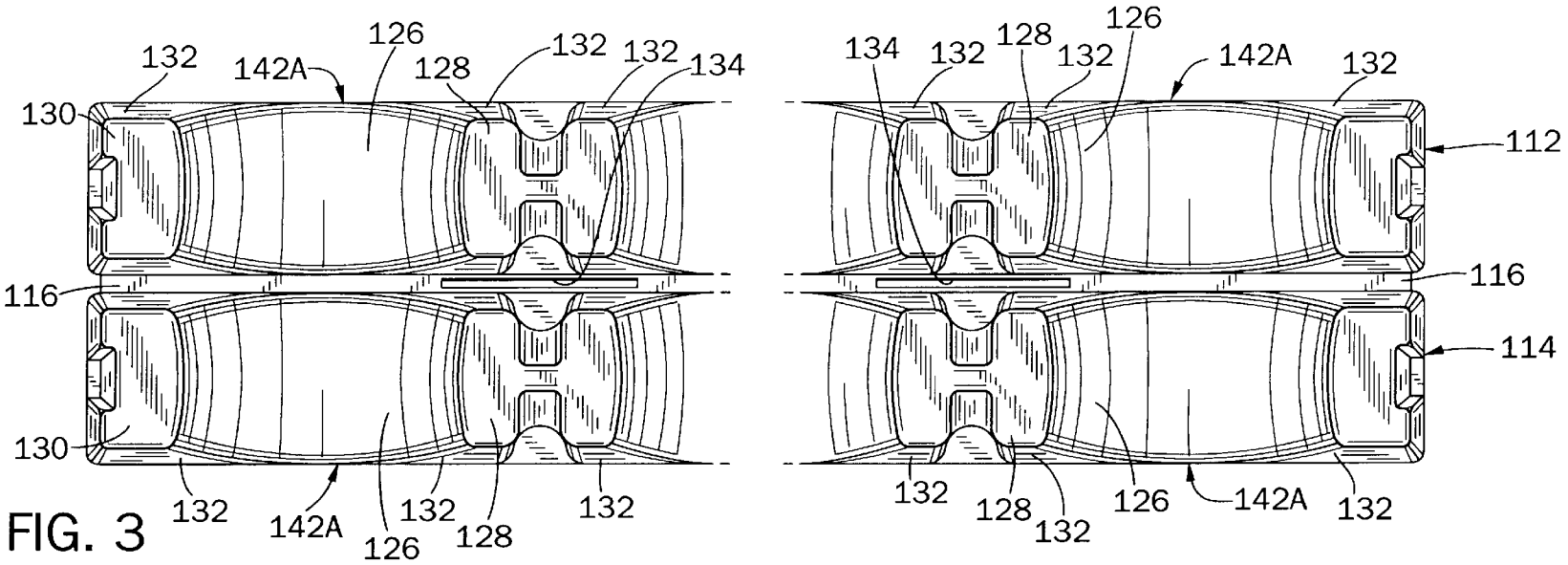

FIG. 3 is a top plan view of the roll support and spacing structure shown in FIG. 2.

Figure 4:
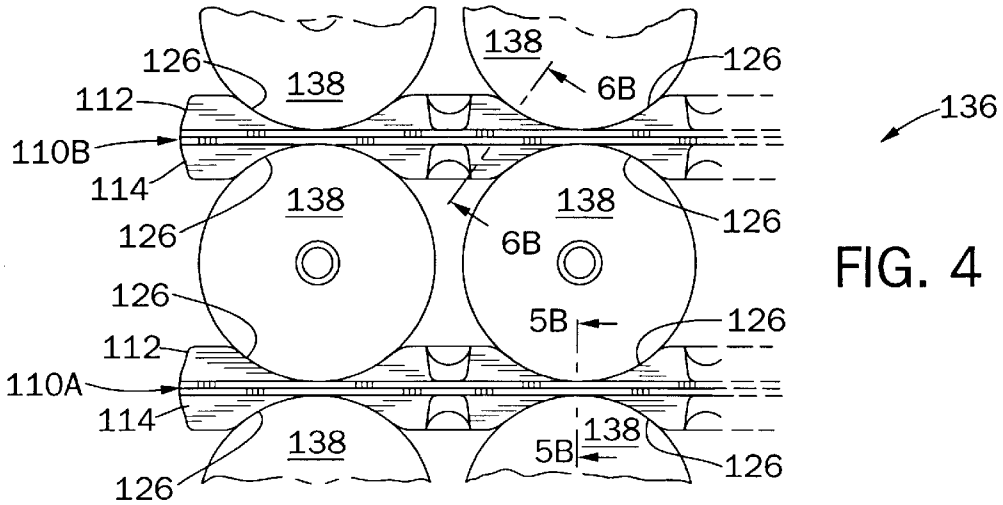

FIG. 4 is a view illustrating the use of the roll support and spacing structure of FIGS. 2 and 3 in a multi-layer stack.

FIG. 5*a* is a view taken along line 5*a*—5*a* in FIG. 2.

FIG. 5*b* is a view similar to FIG. 5*a* shown when the roll support and spacing structure is under a load in a multi-layer stack.

FIG. 6*a* is a view taken along line 6*a*—6*a* in FIG. 2.

FIG. 6*b* is a view similar to FIG. 6*a* shown when the roll support and pacing structure is under a load in a multi-layer stack.

FIG. 7 is a detailed view of the area defined by line 7—7 in FIG. 6*b* of a chamfered surface as in accordance with a preferred embodiment of the invention.

Figure 8:
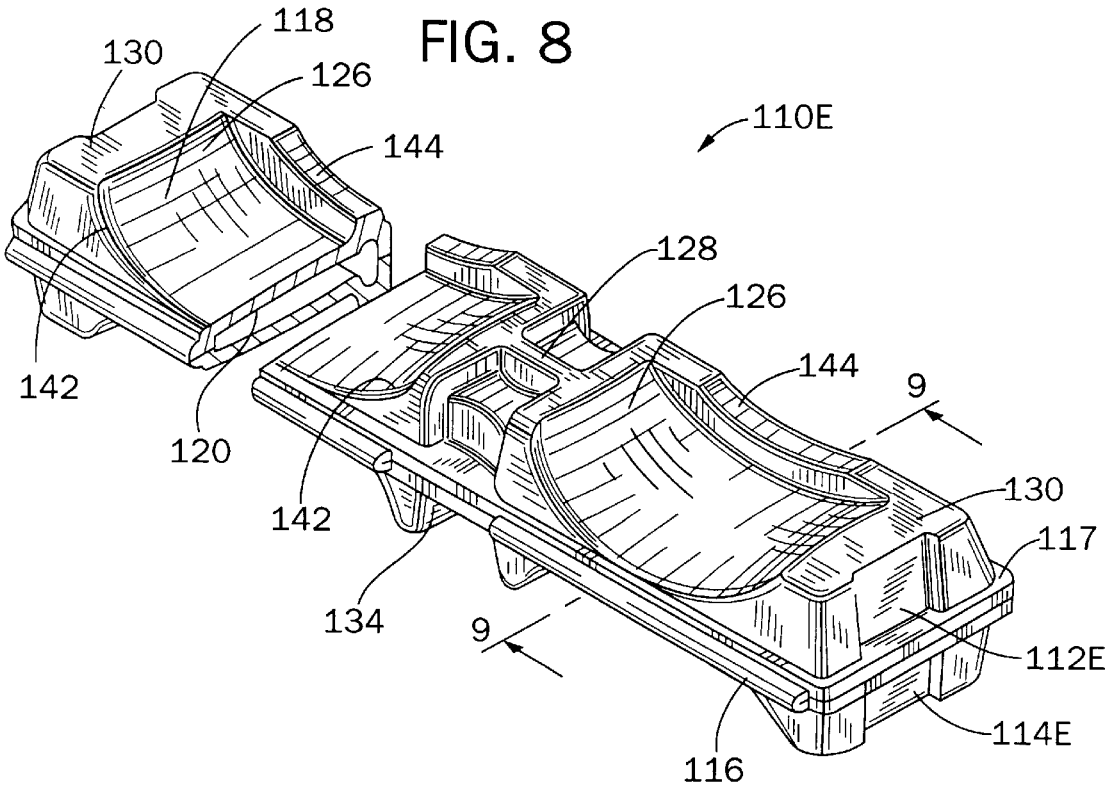

FIG. 8 is a perspective view of a roll support and spacing structure having smooth and crowned, generally semi-cylindrical roll indentations as in accordance with he invention, as well as a lip for protecting the axial exposed ends of rolls of web material.

Figure 9:
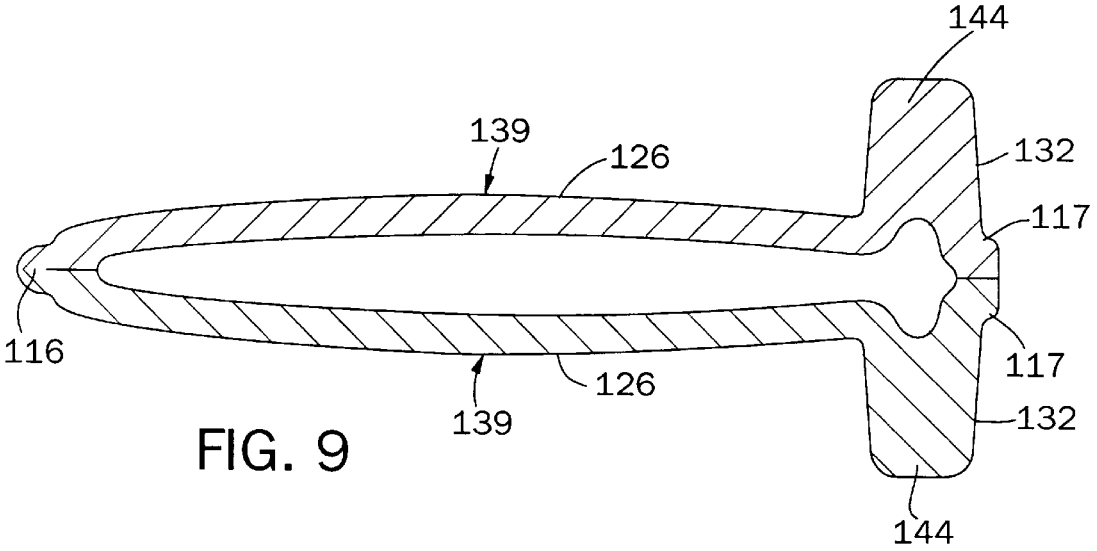

FIG. 9 is a view taken along line 9—9 in FIG. 8.

Figure 10:
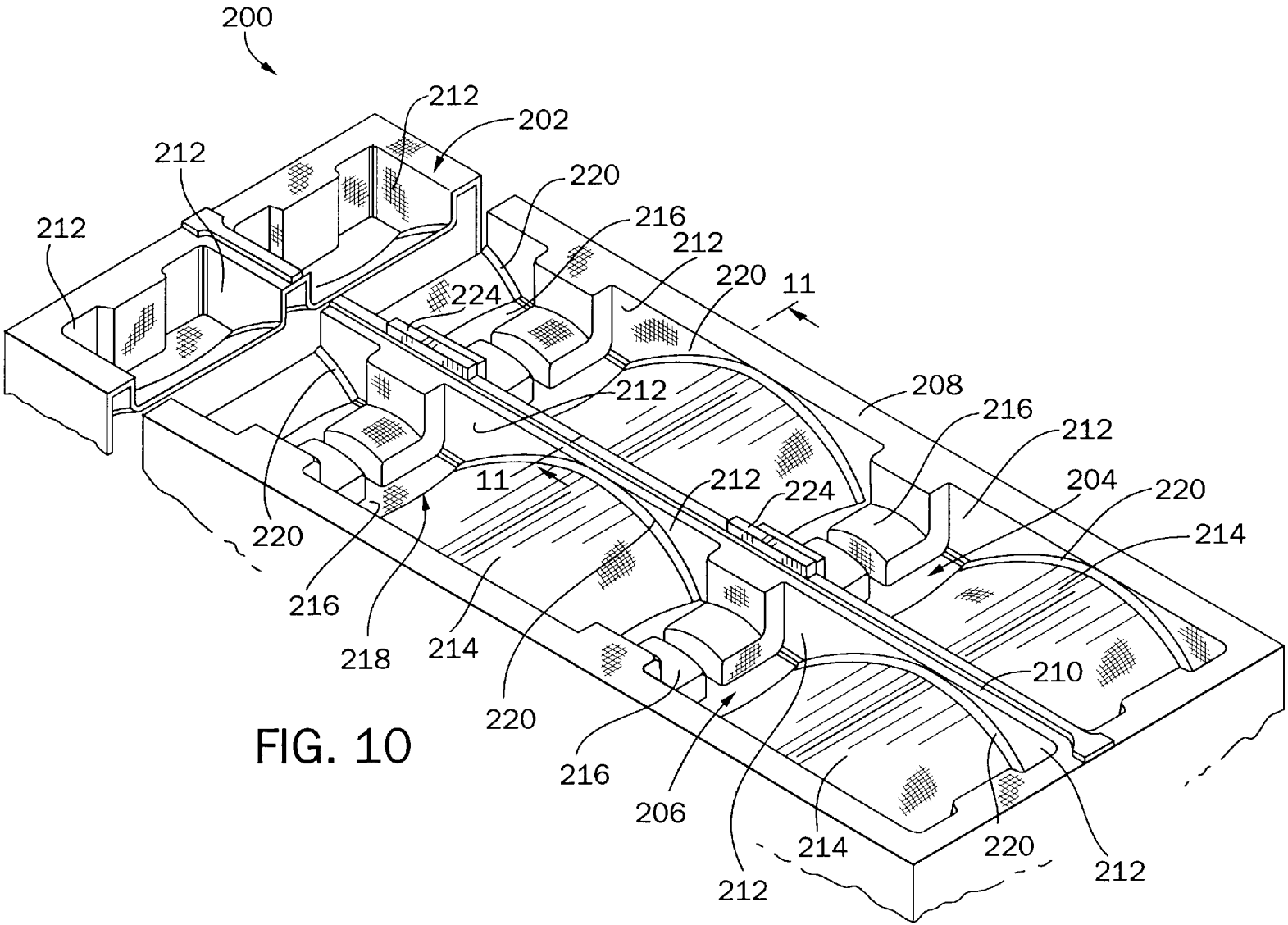

FIG. 10 is a perspective view of a foraminous mold for the molded pulp roll support and spacing structure shown in FIGS. 2 and 3.

Figure 11:
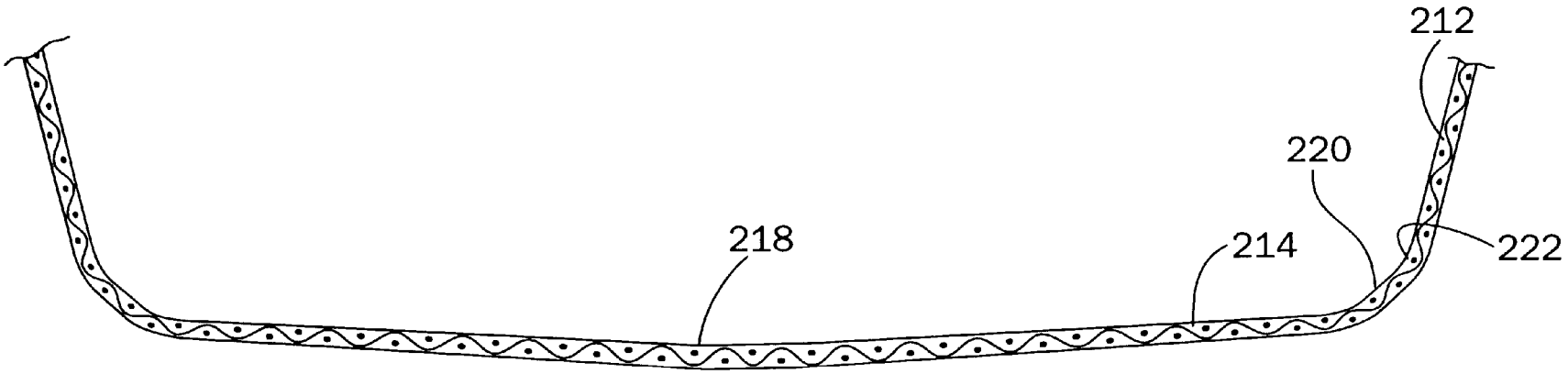

FIG. 11 is a cross-sectional view taken along line 11—11 in FIG. 10.

DETAILED DESCRIPTION OF THE DRAWINGS

Prior Art

Figure 1:
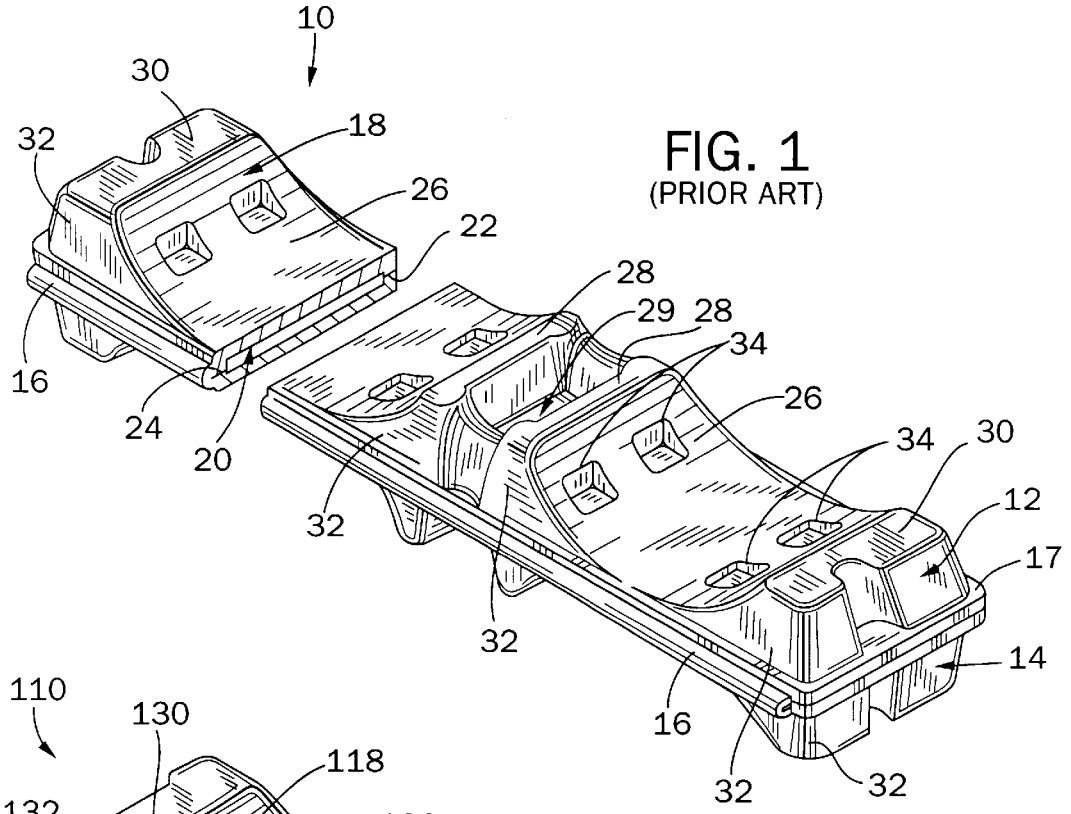
FIG. 1 (PRIOR ART)
FIG. 1 is a perspective view of a molded pulp roll support and spacing structure having flexural cushioning recesses in semi-cylindrical roll cushioning indentations as in accordance with the prior art.

A molded pulp roll support and spacing structure 10 in accordance with the prior art is shown in FIG. 1. The structure 10 includes first 12 and second 14 elongated members formed of dried and/or cured molded pulp. The first 12 and second 14 elongated members are connected along a hinge 16. Each of the elongated members 12, 14 has a molded surface 18 and a felted surface 20. The felted surface 20 for each of the elongated members 12, 14 has a peripheral engagement portion 22, 24, which is generally flat, but may be uneven due to raw material build-up during molding. When the structure 10 is folded along the hinge 16, the peripheral engagement portion 22 for the first elongated member 12 aligns with the peripheral engagement portion 24 for the second elongated member 14. The molded surface of the elongated members 12, 14 includes a plurality of parallel, spaced-apart, generally semi-cylindrical roll cushioning indentations 26. The generally semi-cylindrical roll cushioning indentations 26 are disposed to receive rolls of web material such as films or the like.

The elongated members 12, 14 include raised intermediate lands 28 positioned between adjacent roll cushioning indentations 26. The intermediate lands 28 are preferably reinforced (e.g. recess 29) to enhance the strength of the lands 28. The elongated members 12, 14 also include lands 30 at the ends of the respective elongated member 12, 14.

Sidewalls 32 for the elongated members 12, 14 extend from a border 17 on the molded surface that opposes the peripheral engagement portion 22, 24 of the felted surface. The sidewalls 32 support the generally semi-cylindrical roll cushioning indentations 26 and the lands 28, 30, at least partially, both during drying and in use. In accordance with the prior art, a pair of recesses 34 are also included in the generally semi-cylindrical roll cushioning indentations 26.

The prior art molded pulp structure 10 shown in FIG. 1 is formed by submerging a foraminous mold in a pulp mixture (e.g. a water and fiber slurry including a corrugated and newspaper blend) and applying a vacuum to the mold. The mold is then removed from the slurry. The wet pulp structure is then placed on a screen, and dried and cured. The recesses 34 in the roll cushioning indentations 26 are normally needed to eliminate sagging or caving of the indentations 26 before the wet molded pulp structure 10 is dried and cured. The recesses 34 in the generally semi-cylindrical roll cushioning indentations 26 also provide the proper combination of strength and flexibility so that the indentations can adequately cushion the rolls of web material, without crushing the molded structure 10. Such crushing can cause an improper fit, which sometimes causes poor weight distribution that flattens the rolls of web material, and possibly cause load collapse. Recess 34 in the roll cushioning indentations have therefore been widely used in the prior art.

One of the primary drawbacks of the recesses 34 is that the recesses 34 can cause markings, dents and/or scratches on the rolls of web material, especially under heavy loads, due to uneven weight distribution on the rolls in the vicinity of the recesses 34.

Present Invention

FIG. 2 illustrates a roll support and stacking structure 110 in which the generally semi-cylindrical roll cushioning indentations 126 are smooth and free of recesses as in accordance with the preferred embodiment of the invention.

The roll support and stacking structure 110 includes a first 112 and second 114 elongated member which are connected along integral hinge 116. Each elongated member 112, 114 includes a face side surface 118 and a back side 120. If the structure 110 is made from molded pulp, the face side surface 118 is a molded surface, and the back side surface 120 is a felted surface. The back side surface for both elongated members 112, 114 has a peripheral engagement portion 122, 124. When folded along the hinge 116, the peripheral engagement portion 122 of the back side surface of the first elongated member 112 aligns with the peripheral engagement portion 124 of the back side surface of the second elongated member 114.

The face side surface 118 for each elongated member 112, 114 shown in FIG. 2 includes a plurality of generally semi-cylindrical roll cushioning indentations 126. The radius of the generally semi-cylindrical roll cushioning indentations 126 is greater than the depth of the respective indentation such that roll support and spacing structure 110 separating the various layers in a stack 136 will not be in contact with one another (see FIG. 4). The roll cushioning indentations 126 are sized appropriately to generally fit rolls of web material. As discussed in more detail below, the roll support and spacing structure 110 is designed to accommodate rolls having relatively slight diameter variations (e.g. roll diameter variations of approximately 1 to 2 inches). A reasonably accurate fit is important for even load distribution. Roll support and spacing structures 110 are preferably made in various sizes to accommodate, for example, 6 inch rolls, 8 inch rolls, 9 inch rolls, 10 inch rolls, 12 inch rolls, 14 inch rolls, etc. Note that the invention is also applicable to roll support structures having a single roll indentation which are typically used to support large rolls of web material.

The generally semi-cylindrical roll cushioning indentations 126 are separated by raised, reinforced intermediate lands 128. The preferred design for the raised, reinforced intermediate lands 128 is disclosed in copending U.S. patent application Ser. No. 29/079,042, entitled "Land for Roll Support", filed on Nov. 7, 1997, now U.S. Pat. No. D408737, which is a continuation application of U.S. Pat. No. Des. 403,961, and incorporated herein by reference. The ends of the elongated members 112, 114 also include lands 130. Each elongated member 112, 114 has sidewalls 132 that extend from the border 117 of the face side surface which opposes the peripheral engagement portion 122, 124 of the back side surface 120 (including the portion adjacent the hinge 116). The sidewalls 132 support the generally semi-cylindrical roll cushioning indentations 126 and the lands 128, 130 (at least partially) with respect to the peripheral engagement portion 122, 124 of the back side surface.

As mentioned, the roll support and spacing structure is preferably fabricated from molded pulp. FIG. 3 illustrates the molded pulp structure 110 as fabricated before the structure 110 is folded or torn along the hinge 116. To fabricate the structure 110, it has been found that a pulp mixture containing 60% corrugated and 40% newspaper normally has sufficient strength and flexibility, although other mixtures are likely to be suitable depending on the particular molding process. Preferably, a vacuum is drawn on the submerged foraminous mold (see FIGS. 10 and 11) so that the molded pulp structure 110 typically has a thickness of about ¼ to 5/16 of an inch. The wet molded pulp structure 110 is then dried and cured.

The structure 110 is folded along hinge 116 to form a member such as shown in FIGS. 2 and 4 that resides between layers of rolls of web material. The structure 110 is torn or cut along the hinge line 116 when the member is used along the top or bottom rows of rolls of web material. In order to facilitate accurate folding and/or tearing along the hinge 116, the molded pulp structure 110 preferably contains formed elongated openings 134. The formed openings 134 are preferably located between opposing intermediate lands 128 on the respective elongated members 112, 114, respectively. The elongated formed openings are preferably about ¼ inch wide, and approximately 1½ to 2 inches long.

FIG. 4 illustrates the use of the roll support and spacing structure 110 in a multi-layer stack 136 of rolls 138 of web material. By way of example, assume that the rolls 138 in FIG. 4 have a 12 inch diameter, then the distance between the center points of adjacent generally semi-cylindrical roll cushioning indentations 126 must be greater than or equal to 12 inches, preferably about 13 inches. The height of the sidewalls 132 at the lands 128, 130 is preferably approximately 2 inches, although the height can vary substantially depending on the design. Note again that the radius of the generally semi-cylindrical roll cushioning indentations 126 are selected to retain the respective rolls 138 within the indentations 126, and it is important that the indentations 126 maintain dimensional and structural integrity both during fabrication and in use under heavy loads.

Referring now to FIGS. 5*a*, 5*b*, the face side surface 118 of each generally semi-cylindrical roll cushioning indentations 126 is crowned such that the surface 118 (i.e. as shown in FIG. 5*a*) is convex when the elongated members 112, 114 are not under load. The crown on the semi-cylindrical roll cushioning indentations 126 is longitudinal and preferably centered on the longitudinal centerline of the face side surface 118 of the indentation 126. When the roll support structure 110 is not under load, the apex 139 of the crown is preferably about ⅛ of an inch outward from the lower portions 140 of the indentation surface 118 away from the longitudinal centerline. When the roll support structure 110 is loaded by rolls (see FIG. 5*b*), the apex 139 of the crown flattens slightly and the indentation surface 118 evenly supports the rolls 138.

FIG. 6*a* is a transverse cross-section through the generally semi-cylindrical roll cushioning indentation as taken along lines 6*a*—6*a* in FIGS. 2 and 4. The crown preferably continues longitudinally along the entire length of the respective semi-cylindrical roll cushioning indentation 126. When the molded pulp structure 110 is not under load, the apex 139 of the crown through the transverse cross-section shown in FIG. 6*a* is also preferably about ⅛ of an inch outward from the lower portions 140 of the indentations 126 located away from the longitudinal centerline. Referring to FIG. 6*b*, the crown 139 substantially flattens when the member 110 is under a load from a roll 138, thus providing substantially even weight distribution across the indentation 126. The crown on the semi-cylindrical roll cushioning indentations 126 provides the indentations 126 with the appropriate combination of strength and flexibility to provide necessary cushioning for the rolls of web material. The crown 139 allows the indentation 126 to generally conform to the shape of the roll to provide adequate cushioning without allowing crushing or load collapse to occur. The crowned semi-cylindrical roll cushioning indentations 126 are generally smooth and free of recesses, and therefore marking, denting or scratching that are sometimes associated with such recesses under heavy loads are eliminated.

In order to substantially eliminate markings on the roll 138 of web material due to the rigidity of sidewalls 132, the face side surface of the roll support structure 110 includes chamfered surface portions 142 that extend between the smooth convex surface of the generally semi-cylindrical roll cushioning indentations 126 and the respective sidewall surface 132. Preferably, the intersection 143, FIG. 7, between the respective sidewall surface 132 and the chamfered surface portion 142 forms an angle of approximately 45°. The chamfered portion 142 is relatively significant (e.g. about ½ of an inch extending between the respective sidewall 132 and the smooth convex surface 126 of the roll cushioning indentation) at the upper end of the chamfered surface 142 near the respective lands 128, 130. As the chamfered surface portion 142 extends towards the center of the respective roll cushioning indentation 126 (e.g. near reference numeral 142*a* in FIG. 3), the chamfered surface portion 142 blends into the hinge 116 or border 117, respectively.

FIGS. 8 and 9 show another embodiment of the invention which includes an endwall protective lip 144. In many respects, the roll support structure 110*e* shown in FIGS. 8 and 9 is similar to the roll support structure 110 illustrated in FIGS. 2–7, and like reference numerals are used where appropriate to facilitate understanding of the invention. The roll support structure 110*e* shown in FIGS. 8 and 9 includes the endwall protective lip 144 to protect otherwise exposed axial ends of rolls from nicks or other damage. The structure 110*e* is normally used on the exterior of a stack. The roll support structure 110*e* can be used between subsequent layers of a stack as shown in the folded form of FIG. 8, or can be used for the top and bottom layers by tearing along the hinge 116 in order to separate the first elongated member 112*e* from the second elongated member 114*e*. Note that the roll support structure 110*e* shown in FIGS. 8 and 9 preferably includes elongated formed openings 134 along the hinge as shown in the structure 110 described with respect to FIGS. 2–7. In accordance with the preferred embodiment of the invention, the generally semi-cylindrical roll cushioning indentations 126 are crowned longitudinally, see FIG. 9, as in the roll support structure 110 shown in FIGS. 2–7. In addition, the structure 110*e* shown in FIG. 8 also includes chamfered surface portions 142 spanning between the smooth crowned roll cushioning surface 126 and the respective sidewall 132 on the side of the respective elongated member 112*e*, 114*e* opposite the protective lip 144. As shown best in FIG. 9, the protective lips 144 on the elongated members 112*e*, 114*e* extend continually from the sidewalls 132 past the height of the crowned surface for respective generally cylindrical roll cushioning indentation 126. There is no need for a chamfered portion 142 adjacent the endwall protective lips 144.

FIGS. 10 and 11 show the preferred configuration for the forming surface 202 of a foraminous mold 200 used to fabricate the formed molded pulp roll support structure 110 as shown in FIGS. 2–7. The forming surface 202 contains a first elongated member molding cavity 204 and a second elongated member molding cavity 206. The first 204 and second 206 molding cavities are surrounded by a generally planar periphery 208. The first 204 and second 206 molding cavities are parallel to each other and are separated by a longitudinal hinge portion 210. The longitudinal hinge portion 210 is generally coplanar with the generally planar periphery 208. The first 204 and second 206 molding cavities contain sidewalls 212 that extend from at least a portion of the generally planar periphery 208 and from the coplanar longitudinal hinge portion 210 into the respective molding cavity 204, 206. Each of the molding cavities 204, 206 includes a plurality of generally semi-cylindrical humps 214. The generally semi-cylindrical humps 214 form the generally semi-cylindrical roll cushioning indentations in the resulting molded product. The generally semi-cylindrical humps 214 are separated by land formation areas 216 which are positioned adjacent the generally semi-cylindrical humps 214.

In accordance with the invention, the mold forming surface 202 on the generally semi-cylindrical humps 214 is smooth and dished longitudinally such that a transverse cross-section of the forming surface 202 across the generally cylindrical humps 214 in the respective molding cavities is concave as shown by reference numeral 218 in FIG. 11. Additionally, see reference numeral 218 in FIG. 10 at the interface between semi-cylindrical hump 214 and land formation area 216. It should be noted that it is preferred in accordance with the invention that the dried molded pulp roll support structure 110 have a longitudinal crown as illustrated in FIGS. 5*a* and 6*a*, however, it may be useful to dish the generally semi-cylindrical hump 214 on the molding surface 202 even if the resulting dried molded pulp roll support 110 does not retain a longitudinal crown along the semi-cylindrical roll cushioning indentations 126. The depth of the longitudinal dish, represented by numeral 218, on the semi-cylindrical humps 214 of the forming surface 202 depends on the parameters of the fabrication process (e.g. pulp slurry content, vacuum strength and duration, drying techniques, etc.), but is preferably about ⅛ inch.

In accordance with the invention, the forming surface 202 on the foraminous mold 200 contains chamfered portions 220 in the molding cavities 204, 206. The chamfered portions 220 extend between the concave or dished forming surface of the generally semi-cylindrical humps 214 and the respective adjacent sidewall surface 212 (see FIG. 11). As previously discussed, it is preferred that the intersection 222 between the chamfered portion 220 and the sidewall surface form approximately a 45° angle.

The elongated openings 134 in the roll support structure 110, which facilitate bending and/or tearing along the hinge 116 (see FIGS. 2–7), are formed by attaching elongated rubber masks 224 to the longitudinal hinge portion 210. The rubber masks protrude away from the longitudinal hinge portion 210. It is preferred that the masks 224 be located between aligned land formation areas 216 for the respective molding cavities 204, 206. In order to form the elongated openings 134, the rubber masks 224 should be of sufficient size to prevent the formation of molded pulp structure on the area of the mold 200 covered by the elongated masks 224 during the fabrication process. The rubber masks 224 preferably have a height of about ⅜ of an inch, are about ¼ of an inch wide, and have a length of 1½ to 2 inches.

The preferred embodiments of the invention have been disclosed herein, however, the scope of the invention is not limited to these disclosed preferred embodiments. Rather, the following claims are be interpreted to include variations and modifications which do not substantially depart from the true spirit of the invention as claimed below.

We claim:

1. A structure for protectively supporting at least one roll of web material, the structure comprising a formed member wherein:

the formed member has a face side surface and an opposed back side surface;

the face side surface includes sidewalls having at least one generally semi-cylindrical indentation disposed to receive a roll of web material, and lands positioned adjacent the generally semi-cylindrical indentation with one land positioned at each end of the generally semi-cylindrical indentation, the sidewalls at least partially supporting the generally semi-cylindrical indentations and the lands relative to the back side surface;

the radius of the semi-cylindrical indentation is greater than the depth of the indentation such that a pair of formed members retaining a roll of web material therebetween are not in contact with each other; and the face side surface of the generally semi-cylindrical indentation is crowned longitudinally and is free of recesses.

2. A structure for protectively supporting at least one roll of web material as recited in claim 1, wherein the transverse cross-section of the face side surface across the generally semi-cylindrical indentation is generally convex.

3. A structure for protectively supporting at least one roll of web material as recited in claim 1 wherein the formed member is dried molded pulp, and the face side surface is a molded surface and the back side surface is a felted surface.

4. A formed structure as recited in claim 1 wherein:

the structure is used to protectively support and space a plurality of rolls of web material in a multi-layer stack;

the formed member is an elongated member in which the face side surface contains a plurality of parallel, spaced-apart, generally semi-cylindrical indentations disposed to receive rolls of web material, and contains lands positioned between the generally semi-cylindrical indentations; and the face side surface of each generally semi-cylindrical indentation is crowned longitudinally such that a transverse cross-section of the face side surface across the respective generally semi-cylindrical indentation is convex.

5. A structure for protectively supporting and spacing rolls of web material in a multi-layer stack as recited in claim 4 wherein the formed member is dried molded pulp, and the face side surface is a molded surface and the back side surface is a felted surface.

6. A structure for protectively supporting and spacing rolls of web material in a multi-layer stack as recited in claim 5 wherein:

the recited elongated member is a first elongated member and the structure also includes a second elongated member formed of dried molded pulp;

the second elongated member also has a molded surface and an opposed felted surface;

the felted surface on the second elongated member has a peripheral engagement portion;

the molded surface on the second elongated member has a sidewall extending from at least a portion of the felted surface, a plurality of parallel, spaced-apart, generally semi-cylindrical roll indentations disposed to receive rolls of web material, and lands positioned between respective generally semi-cylindrical roll indentations, the sidewall at least partially supporting the respective generally semi-cylindrical roll indentations and the lands relative to the felted surface;

the radius of each of the generally semi-cylindrical roll indentations is greater than the depth of the indentation such that a pair of molded pulp structures retaining rolls of web material therebetween are not in contact with each other; and the molded surface of the generally semi-cylindrical roll indentations is smooth and crowned such that a transverse cross-section of the molded surface of the indentations is convex; and further wherein:

the first and second elongated members on the structure are formed parallel to each other and are connected by an integral molded pulp hinge therebetween, the hinge having a plurality of formed elongated openings therein to facilitate bending along the hinge; and the peripheral engagement portion of the felted surface of the second elongated member on the structure aligns with the peripheral engagement portion of the felted surface of the first elongated member of the structure when the structure is folded along the hinge.

7. A structure for protectively supporting and spacing rolls of web material in a multi-layer stack as recited in claim 6 wherein:

the position of the semi-cylindrical roll indentations and the lands on the first elongated member of the structure are in alignment across the hinge with the position of the semi-cylindrical roll indentations and the lands on the second elongated member of the structure; and the elongated opening are located exclusively in the hinge between selected aligned lands.

8. A structure for protectively supporting at least one roll of web material, the structure comprising a formed member wherein:

the formed member has a face side surface and an opposed back side surface:

the face side surface includes sidewalls having at least one generally semi-cylindrical indentation disposed to receive a roll of web material, and lands positioned adjacent the generally semi-cylindrical indentation with one land positioned at each end of the generally semi-cylindrical indentation, the sidewalls at least partially supporting the generally semi-cylindrical indentations and the lands relative to the back side surface, the radius of the semi-cylindrical indentation is greater than the depth of the indentation such that a pair of formed members retaining a roll of web material therebetween are not in contact with each other;

the face side surface of the generally semi-cylindrical indentation is crowned longitudinally, and the transverse cross-section of the face side surface across the generally semi-cylindrical indentation is generally convex; and a chamfered surface portion on the face side surface that extends between the convex surface of the generally semi-cylindrical roll indentation and the respective adjacent sidewall surface.

9. A structure for protectively supporting and at least one roll of web material as recited in claim 8 wherein an intersection between the chamfered surface portion and the respective adjacent sidewall surface forms approximately a 45° angle.

10. A structure for protectively supporting at least one roll of web material, the structure comprising a formed member wherein:

the formed member has a face side surface and an opposed back side surface;

the face side surface includes sidewalls having at least one generally semi-cylindrical indentation disposed to receive a roll of web material, and lands positioned adjacent the generally semi-cylindrical indentation with one land positioned at each end of the generally semi-cylindrical indentation, the sidewalls at least partially supporting the generally semi-cylindrical indentations and the lands relative to the back side surface;

the radius of the semi-cylindrical indentation is greater than the depth of the indentation such that a pair of formed members retaining a roll of web material therebetween are not in contact with each other;

the face side surface of the generally semi-cylindrical indentation is crowned longitudinally;

an endwall protective lip on the formed member extending continually from one of the adjacent sidewalls past the surface of the generally semi-cylindrical roll indentation; and a chamfered surface portion on the face side surface that extends between the surface of the semi-cylindrical roll indentation and the sidewall surface of the formed member opposite the endwall protective lip.

11. A structure for protectively supporting at least one roll of web material, the structure comprising a formed member wherein:

the formed member has a face side and an opposed back side;

the back side surface includes a peripheral engagement portion;

the face side surface includes sidewalls extending from at least a portion of the peripheral engagement portion of the back side surface, at least one generally semi-cylindrical indentation disposed to receive a roll of web material, and lands positioned adjacent the generally semi-cylindrical indentation with one land positioned at each end of the generally semi-cylindrical indentation, the sidewalls at least partially supporting the generally semi-cylindrical indentations and the lands relative to the peripheral engagement portion of the back side surface;

the radius of the semi-cylindrical indentation is greater than the depth of the indentation such that a pair of formed members retaining a roll of web material therebetween are not in contact with each other; and the face side surface includes a chamfered surface portion that extends between the face side surface of the generally semi-cylindrical indentation and the face side surface of the respective adjacent sidewall surface.

12. A structure for protectively supporting at least one roll of web material as recited in claim 11 wherein an intersection between the chamfered surface portion and the respective adjacent sidewall surface forms approximately a 45° angle.

13. A structure for protectively supporting at least one roll of web material as recited in claim 11 further comprising:

an endwall protective lip on the formed member extending continually from one of the adjacent sidewalls past the face side surface of the generally cylindrical roll indentation; and a chamfered surface portion on the face side surface that extends between the generally semi-cylindrical indentation portion of the face side surface and the sidewall surface of the formed member opposite the endwall protective lip.

14. A structure for protectively supporting at least one roll of web material as recited in claim 13 wherein an intersection between the chamfered surface portion and the respective adjacent sidewall surface forms approximately a 45° angle.

15. A structure for protectively supporting at least one roll of web material as recited in claim 11 wherein the formed member is formed from dried molded pulp, and the face side surface is a molded surface and the back side surface is a felted surface.

16. A formed structure as recited in claim 11 wherein:

the structure is used to protectively support and space a plurality of rolls of web material in a multi-layer stack;

the formed member is an elongated member in which the face side surface contains a plurality of parallel, spaced-apart, generally semi-cylindrical indentations disposed to receive rolls of web material, and contains lands positioned between the generally semi-cylindrical indentations; and the face side surface contains at least one chamfered portion for each semi-cylindrical indentation that extends between the face side surface of the respective generally semi-cylindrical indentation and the face side surface of the respective adjacent sidewall surface.

17. A structure for protectively supporting and spacing rolls of web material in a multi-layer stack as recited in claim 16 wherein the formed member is formed from dried molded pulp, and the face side surface is a molded surface and the back side surface is a felted surface.

18. A structure for protectively supporting and spacing rolls of web material in a multi-layer stack as recited in claim 16 wherein the intersections between each chamfered surface portion and the respective adjacent sidewall surface forms approximately a 45° angle.

* * * * *